US005105830A

United States Patent [19]

Brackmann et al.

[11] Patent Number: 5,105,830

[45] Date of Patent: Apr. 21, 1992

[54] DEVICE AND METHOD FOR ASSEMBLY OF CIGARETTES

[75] Inventors: Warren A. Brackmann, Mississauga; Kenneth P. Davidson, Toronto; Hans Klotz, Scarborough; Michael H. Sheahan, Whitby; Stanislav M. Snaidr, Mississauga, all of Canada

[73] Assignee: Rothmans, Benson & Hedges Inc., North York, Canada

[21] Appl. No.: 487,262

[22] Filed: Mar. 2, 1990

[30] Foreign Application Priority Data

Mar. 8, 1989 [GB] United Kingdom ..... 8905272
Aug. 8, 1989 [GB] United Kingdom ..... 8918100

[51] Int. Cl.[5] ..... A24C 5/02; A24C 5/06

[52] U.S. Cl. ..... 131/70; 131/72; 131/75

[58] Field of Search ..... 131/70, 72, 75

[56] References Cited

U.S. PATENT DOCUMENTS 3,822,710 7/1974 Bramhill ..... 131/70

FOREIGN PATENT DOCUMENTS 1214972 12/1986 Canada ..... 131/70
1226500 4/1987 Canada ..... 131/70
0123150 3/1984 European Pat. Off. .
0140129 9/1984 European Pat. Off. .
3744670 6/1988 Fed. Rep. of Germany ..... 131/72

*Primary Examiner*—V. Millin
*Attorney, Agent, or Firm*—Sim & McBurney

[57] ABSTRACT

Individual assembly of cigarettes from cut tobacco and preformed cigarette paper tubes is facilitated by providing charges of cut tobacco in cartridges. An extension in the form of a hollow tube is provided at one end of the cartridge to enable the sheath enclosing the tobacco to be removed and the tobacco discharged into the paper tube. Specific equipment to effect the assembly also is described.

25 Claims, 3 Drawing Sheets

12
14
16
18
20
22
24
26
28
30
32
34
36
38
40
42
44

10

DEVICE AND METHOD FOR ASSEMBLY OF CIGARETTES

FIELD OF INVENTION

The present invention is concerned with the formation of cigarettes by individuals, particularly a device and procedure for effecting the same.

BACKGROUND TO THE INVENTION

The assembly of cigarettes by the consumer has been known in various forms for a long time. One of the simplest procedures in this regard involves placing a charge of tobacco on a cigarette paper and then rolling it into a rod and sealing it. This procedure requires a degree of manual skill and is time consuming. Simple roller devices comprising a pair of rollers and an endless belt have been employed to improve the assembly procedure.

One of the appeals of "roll-your-own" cigarettes to certain smokers is the lower cost of the resulting cigarette, since tobacco sold in loose form or some other inherently-unsmokeable form attracts a much lower excise tax than tobacco sold in the form of ready-to-smoke cigarettes in many jurisdictions, so that the cost to the smoker of the self-assembled cigarette is much lower than machine-assembled cigarettes.

One of the problems that the individual assembling the cigarette encounters is obtaining a consistency in the quantity of the tobacco charge employed and hence obtaining a consistency in smoking quality.

Several suggestions have been made in the prior art to mechanize the operation of cigarette formation. One such prior art suggestion appears in U.S. Pat. No. 3,822,710 to Percy W. Bramhill. In the Bramhill structure, a preformed cigarette tube, usually having a filter attached thereto, receives a charge of tobacco from a tobacco cartridge comprising a rod of compressed tobacco enclosed in a thin, low friction, non-consumable material which is not smoked by the smoker.

Specifically it is indicated in the patent that the material of the sheath should be heat sealable or gluable and that coated cellulose film sold under the trademark "Cellophane" by DuPont is preferred.

The length of tobacco in the cartridges is slightly greater than the length of the empty portion of the cigarette tube and the external diameter of the cartridge is slightly less than the internal diameter of the paper tube, to permit the tobacco cartridge to be inserted into the paper tube to fill the tube and project slightly beyond the end of the tube. The outer sheath of the tobacco cartridge is removed prior to making the cigarette.

With the Bramhill machine, the cartridge is inserted by hand as far as it will go into the paper tube and the combination is positioned in a trough with the tobacco resting against a stop. The cigarette is pushed forward against the stop which causes the sheath to move forwardly over the stop while the tobacco is compressed until the stop is aligned with the end of the paper tube.

A slider is pushed along a rod which has the stop at its end until it abuts the stop from the other side from the tobacco. Two spring fingers on the slider then are used to squeeze the exposed end of sheath into a groove on the slider, so as to grip the sheath therebetween.

The slider then is withdrawn, so that the sheath is pulled out of the cigarette tube. The tobacco is prevented from movement by the stop and remains in the tube. As the sheath is being removed in this way, the tobacco expands to fill the paper tube snugly, as in the factory-made cigarette. When the sheath has been completely removed, the sheath usually is discarded and the cigarette is ready to be smoked.

This prior art procedure and equipment, therefore, requires that the cigarette cartridge be sized to be longer than the paper tube and be completely filled with tobacco. With this arrangement, it is necessary to compress the additional length of tobacco in the cartridge in order to provide a length of sheath which can be gripped so as to enable the sheath to be withdrawn. Compressing of the tobacco causes an uneven hardness of cigarette to result and tobacco to be lost from the end of the cigarette as it expands after the sheath has been removed.

SUMMARY OF INVENTION

In accordance with one aspect of the present invention, this prior art problem is overcome by employing a cartridge which has the same length as the paper tube and comprising a sheath filled with tobacco. The sheath is provided with a tubular extension at one end thereof.

Accordingly, in one aspect of the present invention, there is provided a cartridge useful for assembly of cigarettes, comprising a charge of cut tobacco within a tubular sheath having an outside diameter such as to enable said sheath to be received in telescoping relationship with the hollow interior of a preformed cigarette paper tube and wherein the charge of cut tobacco is of a length such as to fill at least a portion of the preformed cigarette paper tube when ejected from the tubular sheath into the preformed cigarette paper tube; and extension means extending from one end of the tubular sheath to enable the cartridge to be held during discharge of the charge of tobacco from the sheath into the preformed cigarette paper tube.

By providing the extension means on the sheath, a gripping "handle" is directly provided for the sheath to be withdrawn from the paper tube instead of one having to be formed by compression of a portion of the tobacco charge. In addition, since compression of the tobacco is not required in order for the sheath to be removed from the paper tube, the tobacco retains the same filling power along its length as it had in the cartridge. The possibility of end fall-out from the finished cigarette as a result of tobacco compression is eliminated.

In addition, it is unnecessary for the cartridge to be fully inserted into the paper tube prior to discharge of the tobacco into the paper tube.

The present invention further provides, in other aspects of the invention, method and apparatus for individual assembly of cigarettes which resembles the Bramhill equipment and manner of assembly but, by virtue of the tubular extension on the cartridge, enables assembly to occur without compression of the tobacco and yet permits ready withdrawal of the sheath by a tubular gripping element which overlies the tubular extension.

Accordingly, in another aspect of this invention, there is provided a method of assembly of a cigarette by a plurality of steps. A preformed cigarette paper tube is provided having a tobacco smoke filter at one end and open at the another end to a hollow interior. A preformed cartridge also is provided comprising a charge of cut tobacco within a sheath having a outside diameter such as to enable the sheath to be received in telescoping relationship with the interior of the preformed cigarette paper tube and a hollow tubular extension from one end of the sheath, wherein the charge of cut tobacco is of a length such as to fill at least a portion of the hollow interior of the preformed cigarette paper tube when discharged from the preformed cartridge.

The preformed cartridge is inserted into the hollow interior of the preformed cigarette paper tube such that the sheath is located inside the preformed paper tube and the hollow tubular extension extends from the open end of the preformed paper tube. The preformed paper tube and the charge of tobacco are immobilized relative to one another. The hollow tubular extension is held and pulled to withdraw the sheath from the interior of the preformed cigarette paper tube, whereby the charge of cut tobacco is ejected from the sheath and into the interior of the preformed cigarette paper tube.

The additional gripping element or extension means is conveniently provided by a cylindrical element having an inside diameter the same as the outside diameter of the sheath and adhered adjacent an end of the sheath. Alternatively, a pair of paper strips may be adhered to opposite sides of the sheath or even a large piece with the tip of the sheath attached internally.

The tubular extension on the cartridge may be provided in any convenient manner. For example, a cork wrapper conventionally used to join a filter to a cigarette rod may be employed. Such a tubular extension may be provided by employing a filter-tipping machine in which a hollow plastic tube replaces the filter, so that the cork wrapper is wrapped about the tube and is adhered to the cigarette rod.

Further, there is provided, in an aspect of this invention, apparatus for assembly of a cigarette, comprising elongate frame means; elongate carrier means mounted to the frame means and movable axially with respect to the frame means between first and second extremities of movement for transportation of a cigarette rod thereon; elongate rod means mounted to the frame means and extending axially towards the carrier means in axial alignment with the intended position of a cigarette rod on the carrier means; and sleeve means mounted in slidable relationship on the elongate rod means.

BRIEF DESCRIPTION OF DRAWINGS

FIGS. 1(*a*), (*b*), and (*c*) are side elevational views of a cigarette tube, a tobacco cartridge and an assembly of the tube and cartridge respectively;

DESCRIPTION OF PREFERRED EMBODIMENT

Figures 1A, 1B, 1C, 2:
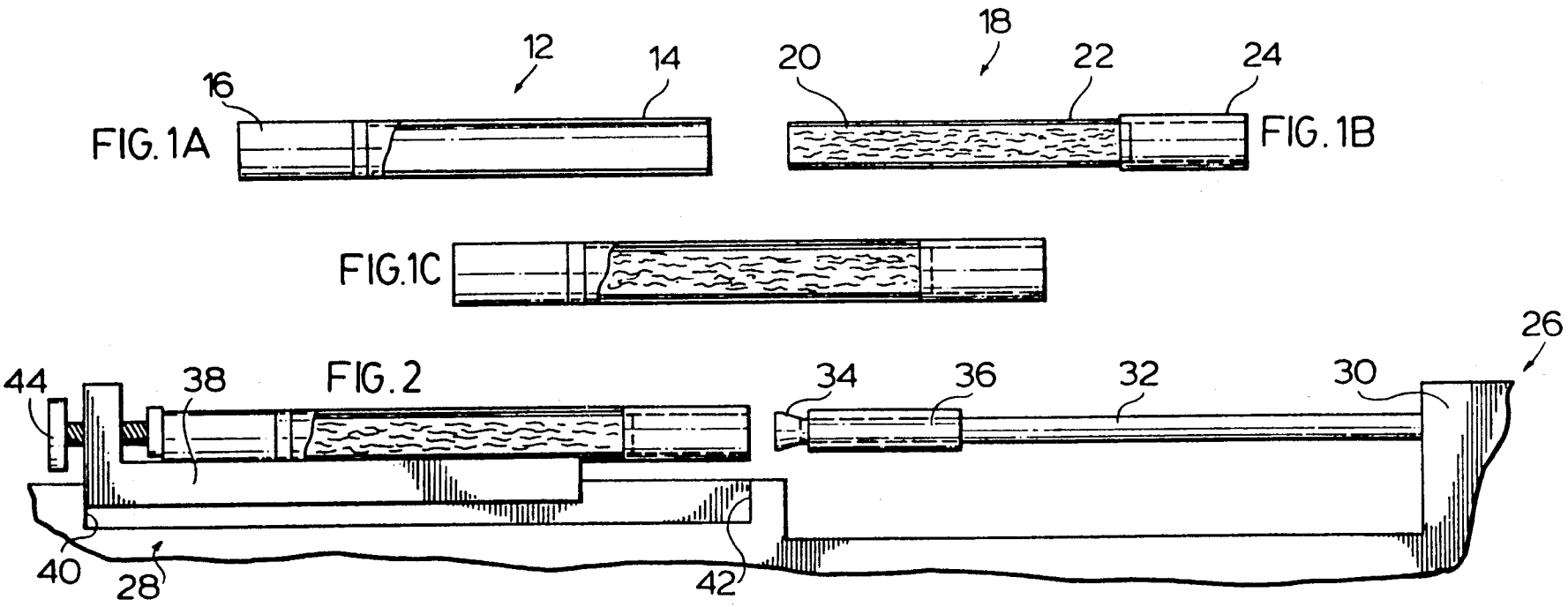
FIGS. 2 to 6 are side elevational views of an assembly device for assembling cigarettes in accordance with one embodiment of the invention in the various stages of assembly.

Referring to the drawings, there is illustrated therein the assembly of a finished cigarette 10 from an empty preformed paper tube 12 comprising a tubular cigarette paper wrapper 14 and a filter 16 and a tobacco cartridge 18 comprising a charge of cut tobacco 20 within an outer wrapper or sheath 22 which has a hollow tubular extension 24 at one end thereof.

The outer diameter of the wrapper 22 of the tobacco cartridge 18 is substantially the same as the inside diameter of the paper wrapper 14 of the paper tube 12, so as to permit the tobacco cartridge 18 to be slid into the paper tube 12 with a snug fit, as seen in FIG. 1(*c*).

The outer wrapper 22 of the tobacco cartridge 18 may be formed of any suitable material to maintain a coherent tubular shape and is of a length corresponding to the length of the paper wrapper 14, so that the tobacco charge 20 contained therein, when discharged from the outer wrapper 22 to the paper tube 14 by the procedure described below, completely fills the paper tube 14.

The tobacco charge 20 comprises the quantity of tobacco desired for the finished cigarette 10 and usually is substantially the same as that present in machine-manufactured cigarettes. If desired, the length of the outer wrapper 22 may be slightly less than the length of the paper wrapper 14, so that the quantity of tobacco in the charge 20 is correspondingly less, for the reasons discussed in more detail below.

Formation of the finished cigarette 10 from the assembly of paper tube 12 and tobacco cartridge 18 is effected using an assembly device 26. The assembly device 26 comprises an elongate body or frame 28 having an upright portion 30 at one end from which extends a rod 32 towards the other end for approximately half the length of the body 28.

The rod 32 is provided with an enlarged diameter portion 34 at its free end and which has a maximum diameter corresponding to the inside diameter of the tubular extension 24, so that the enlarged diameter portion or stop 34 may enter the tubular extension 24 to abut against the tobacco charge 20. A sleeve 36 slidable on rod 32 has an outside diameter corresponding to the inside diameter of the tubular extension 24 so that the sleeve 36 may enter the tubular extension 24.

A carrier 38, which may have an elongate rounded depression or groove in its upper surface and in alignment with the rod 32 for locating the cigarette tube 12 during the assembly operation, is slidably mounted in any convenient manner to the body 28 for reciprocal movement towards and away from the rod 32, with the limits of such reciprocal movement being determined by abutments 40 and 42 formed in the body 28. An adjusting screw 44 may be provided for the purpose of accommodating differing lengths of cigarette tube 12.

The first step of the assembly procedure is to locate the assembly of paper tube 14 and tobacco cartridge 18 in the elongate groove in the carrier 38, while the carrier is located in engagement with abutment 40 (FIG. 2).

The carrier 38 then is slid towards the stationary rod 32 while the sleeve 36 is held at its forwardmost location adjacent the enlarged diameter portion 34, so that both the enlarged diameter portion 34 and the sleeve 36 enter the tubular extension 24. Such movement is continued until the enlarged portion abuts against the end of the tobacco charge 20 in the cartridge 18, which position corresponds to engagement of the carrier 38 with the abutment 42. In this position, the enlarged diameter portion 34 now abuts against the tobacco charge 20.

Figure 3:
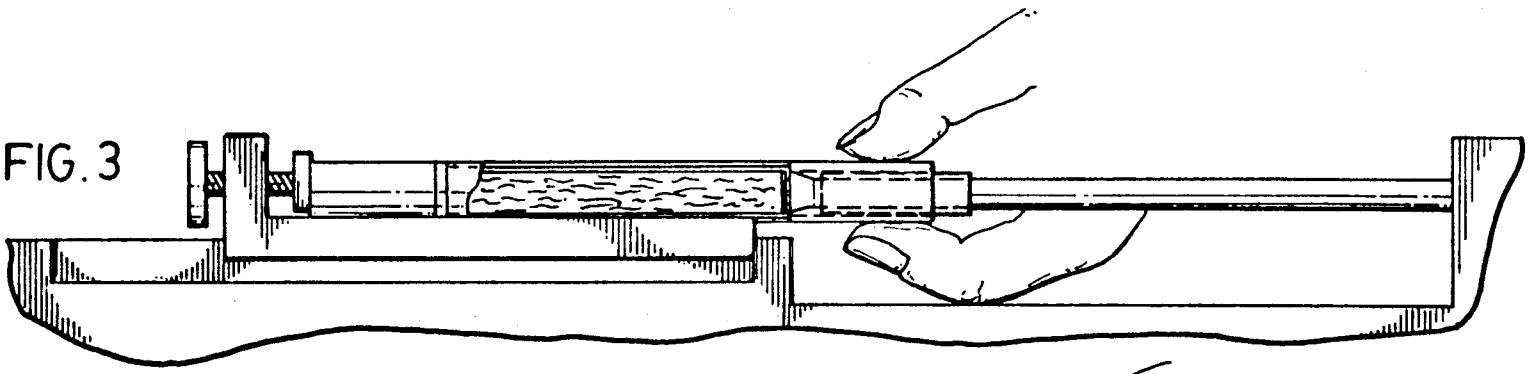
Figure 4:
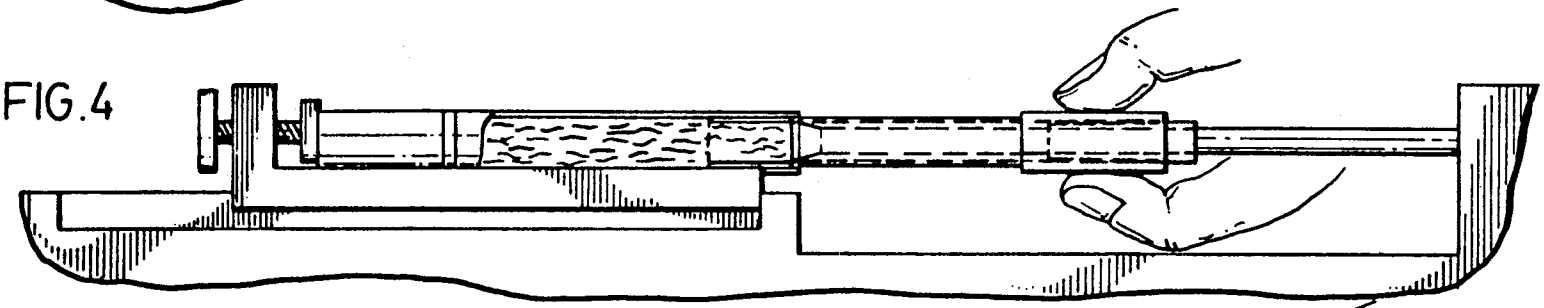

While in this position, the tubular extension 24 then is gripped against the sleeve 36 (FIG. 3) and the carrier 38 is held against the abutment 42. The tubular extension 24 and sleeve 36 then are slid away as the paper tube 12 is held with the tobacco charge 20 in abutment with the enlarged diameter portion 34, so that the sheath 22 is withdrawn from the inside of the outer paper wrapper 14. Since the tobacco charge 20 is prevented from withdrawing with the sheath 22 by reason of its abutment with the enlarged diameter portion 34 of the rod 32, the tobacco charge 20 is ejected from the sheath 22 into the paper tube 14 (FIG. 4).

Figure 5:
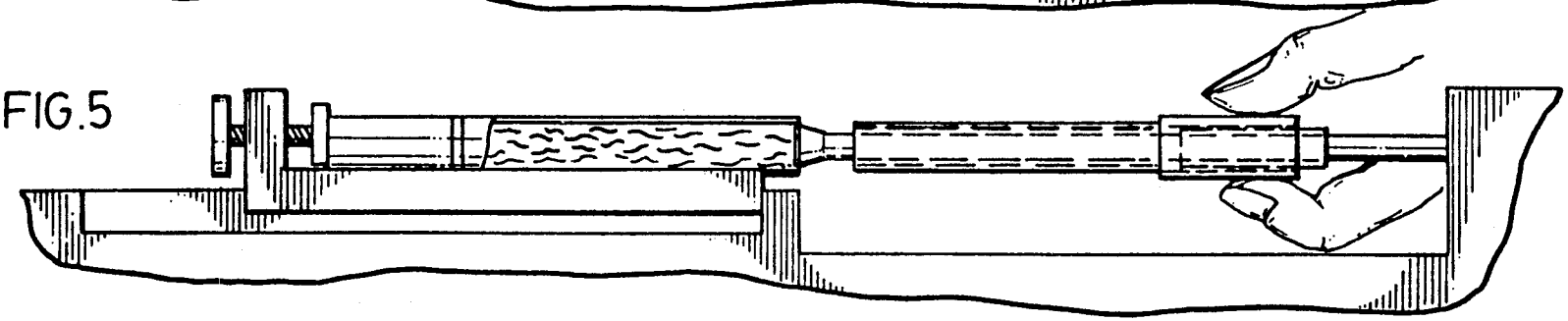
Figure 7B:
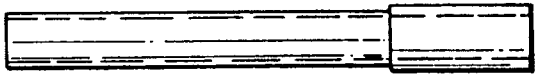
FIGS. 7(*a*) and (*b*) are side elevational views of the finished cigarettes and empty tobacco cartridge respectively.
Figure 7A:
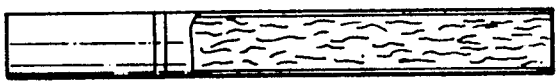
Figure 6:
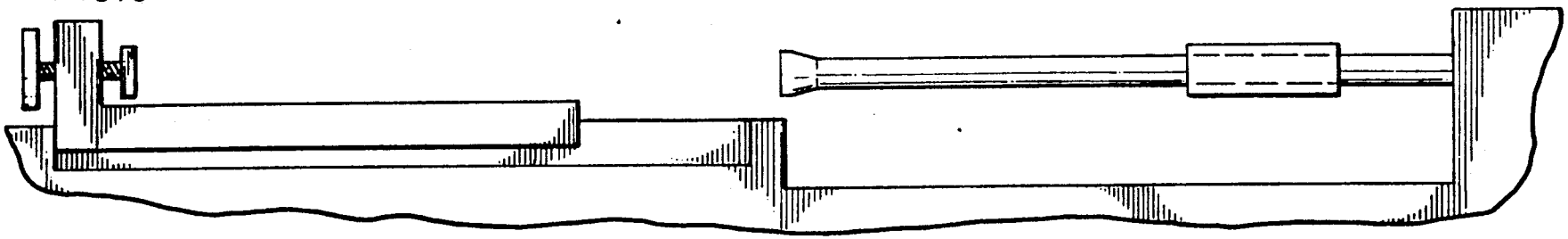

This operation is continued until the sheath 22 is completely withdrawn from the outer cigarette paper tube 14, so that the whole tobacco charge 20 then is located inside the paper tube 12 and a finished cigarette 10 is provided (FIG. 5). The carrier 38 now is retracted and the finished cigarette 10 is removed from the carrier 38. The empty cartridge 18 is removed from the sleeve 36 and the assembly device 26 is ready for reuse to assemble the next cigarette (FIG. 6).

Some prior art systems of assembly of cigarettes in an empty paper tube from a tobacco cartridge rely on locating the tobacco adjacent the filter end of the tube, so that any discrepancy between the desired and actual quantity of tobacco is readily noticeable at the lighting end after assembly.

In the present invention, however, the tobacco is located against the rod end 34 at the lighting end of the cigarette, so that any deficiency in tobacco quantity is not visible at the lighting end but occurs at the filter end, unseen by the smoker.

When the tobacco is ejected from the cartridge 18 into the paper tube 12, there is inevitably a tendency for the tobacco to "creep" which is manifested by tobacco projecting from the open end of the cigarette and being lost. This tendency is exacerbated by the compression procedure used in the prior art Bramhill arrangement.

In accordance with the present invention, the creeping problem can be overcome in one of two ways. In one procedure, the tobacco charge 20 is of less length than the paper wrapper 14 and the rod end 34 is pushed a short way into the paper wrapper 14. When the cigarette 10 is assembled, the tobacco can creep to occupy spaces at both the filter and lighting ends.

In another procedure, the assembled cigarette 10 immediately or shortly following assembly is placed in a rack-like device in which the cigarette is located between abutments. After some time, the tobacco ceases to have a tendency to creep and hence, after removal from the rack, there is no tendency for the tobacco to be lost from the lighting end. The two procedures also may be combined, as desired.

While the apparatus of the present invention generally is employed to assemble cigarettes formed of a single charge of tobacco, however, the technique is adaptable to form cigarettes made up of two or more segments of the same or different blends of tobacco.

SUMMARY OF DISCLOSURE

In summary of this disclosure, the present invention provides a novel method and apparatus for assembling cigarettes by individuals and a novel tobacco cartridge for use therein. Modifications are possible within the scope of this invention.

What we claim is:

1. A cartridge useful for assembly of cigarettes, comprising:

a charge of cut tobacco within a tubular sheath having an outside diameter such as to enable said sheath to be received in telescoping relationship with the hollow interior of a preformed cigarette paper tube and wherein said charge of cut tobacco is of a length such as to fill at least a portion of said preformed cigarette paper tube when ejected from said tubular sheath into said preformed cigarette paper tube, and extension means extending from one end of said tubular sheath to enable said cartridge to be held during discharge of said charge of tobacco from said sheath into said preformed cigarette paper tube, said extension means comprising a hollow cylindrical element having an inside diameter corresponding to the outside diameter of said sheath and adhered to and extending from one end of said sheath.

2. The cartridge of claim 1 wherein said hollow cylindrical element is provided by cigarette smoke filter wrapping paper.

3. The cartridge of claim 1 wherein said charge of cut tobacco substantially completely fills the length of said sheath.

4. The cartridge of claim 3 wherein said sheath has a length corresponding to the length of said preformed cigarette paper tube, whereby a single charge of cut tobacco discharge into said preformed cigarette paper tube provides a cigarette ready for smoking.

5. The cartridge of claim 1, wherein said tubular sheath has an outside diameter corresponding to the inside diameter of said preformed cigarette paper tube, whereby said sheath may be received in sliding fit relationship with the interior of said preformed cigarette paper tube.

6. A cartridge useful for assembly of cigarettes, comprising:

a charge of cut tobacco within a tubular sheath having an outside diameter such as to enable said sheath to be received in telescoping relationship with the hollow interior of a preformed cigarette paper tube and wherein said charge of cut tobacco substantially completely fills the length of said sheath and said charge of cut tobacco and said sheath have a length corresponding to a portion only of the length of said preformed cigarette paper tube, whereby multiple charges of cut tobacco are required to be discharged into said preformed cigarette paper tube to provide a cigarette ready to smoking, and extension means extending from one end of said tubular sheath to enable said cartridge to be held during discharge of said charge of tobacco from said sheath into said preformed cigarette paper tube, said extension means comprising a hollow cylindrical element having an inside diameter corresponding to the outside diameter of said sheath and adhered to and extending from one end of said sheath.

7. The cartridge of claim 6 wherein a plurality of said cartridges is provided, each containing a different blend of tobacco and each of a length such that a combination thereof corresponds in length to the length of said cigarette paper tube, whereby, upon discharge of the required number of charges of cut tobacco to fill said preformed cigarette paper tube, a cigarette ready for smoking is provided containing segments of different blends of tobacco.

8. A cartridge useful for assembly of cigarettes, comprising:

a charge of cut tobacco within a tubular sheath having an outside diameter such as to enable said sheath to be received in telescoping relationship with the hollow interior of a preformed cigarette paper tube and wherein said charge of cut tobacco substantially completely fills the length of said sheath and said charge of cut tobacco and said sheath have a length slightly less than the length of said preformed cigarette paper tube, whereby a single charge of cut tobacco discharged into said preformed cigarette paper tube to provide a cigarette initially having a hollow space at least at the filter end into which the discharged tobacco may creep to fill the space, and extension means extending from one end of said tubular sheath to enable said cartridge to be held during discharge of said charge of tobacco from said sheath into said preformed cigarette paper tube, said extension means comprising a hollow cylindrical element having an inside diameter corresponding to the outside diameter of said sheath and adhered to and extending from one end of said sheath.

9. A method of assembly of a cigarette, which comprises:

providing a preformed cigarette paper tube having a tobacco smoke filter at one end thereof and open at another end thereof to a hollow interior;

providing a preformed cartridge comprising a charge of cut tobacco within a sheath having an outside diameter such as to enable such sheath to be received in telescoping relationship with the interior of said preformed cigarette paper tube and a hollow tubular extension having an inside diameter corresponding to the outside diameter of said sheath and adhered to and extending from one end of said sheath, wherein said charge of cut tobacco is of a length such as to fill at least a portion of said hollow interior of said preformed cigarette paper tube when discharged from said preformed cartridge, inserting said preformed cartridge into the hollow interior of said preformed cigarette paper tube such that the sheath is located inside said preformed paper tube and said hollow tubular extension extends from said open end of said preformed paper tube, immobilizing said preformed paper tube and said charge of tobacco relative to one another, and holding said hollow tubular extension and pulling on said hollow tubular extension to withdraw said sheath from the interior of said preformed cigarette paper tube, whereby said charge of cut tobacco is ejected from said sheath and into the interior of said preformed cigarette paper tube.

10. The method of claim 9 wherein said cartridge contains a charge of tobacco having a length corresponding to the length of the hollow interior of said paper tube.

11. A method of assembly of a cigarette, which comprises:

providing a preformed cigarette paper tube having a tobacco smoke filter at one end thereof and open at another end thereof to a hollow interior;

providing a preformed cartridge comprising a charge of cut tobacco within a sheath having an outside diameter such as to enable such sheath to be received in telescoping relationship with the interior of said preformed cigarette paper tube and a hollow tubular extension from one end of said sheath, wherein said charge of cut tobacco is of a length such as to fill said hollow interior of said preformed cigarette paper tube when discharged from said preformed cartridge, inserting said preformed cartridge into the hollow interior of said preformed cigarette paper tube such that the sheath is located inside said preformed paper tube and said hollow tubular extension extends from said open end of said preformed paper tube, immobilizing said preformed paper tube and said charge of tobacco relative to one another, and holding said hollow tubular extension and pulling on said hollow tubular extension to withdraw said sheath from the interior of said preformed cigarette paper tube, whereby said charge of cut tobacco is ejected from said sheath and into the interior of said preformed cigarette paper tube, and covering the smoking end of said cigarette at least until such time as said discharged tobacco loses its tendency to creep.

12. The method of claim 11 wherein said smoking end of said cigarette is covered by locating the ends of the cigarette between abutments in a rack.

13. A method of assembly of a cigarette, which comprises:

providing a preformed cigarette paper tube having a tobacco smoke filter at one end thereof and open at another end thereof to a hollow interior;

providing a preformed cartridge comprising a charge of cut tobacco within a sheath having an outside diameter such as to enable such sheath to be received in telescoping relationship with the interior of said preformed cigarette paper tube and a hollow tubular extension from one end of said sheath, wherein said charge of cut tobacco is of a length corresponding to slightly less than the length of the hollow interior of preformed cigarette paper tube when discharged from said preformed cartridge, inserting said preformed cartridge into the hollow interior of said preformed cigarette paper tube such that the sheath is located inside said preformed paper tube and said hollow tubular extension extends from said open end of said preformed paper tube, immobilizing said preformed paper tube and said charge of tobacco relative to one another, and holding said hollow tubular extension and pulling on said hollow tubular extension to withdraw said sheath from the interior of said preformed cigarette paper tube, whereby said charge of cut tobacco is ejected from said sheath and into the interior of said preformed cigarette paper tube to form a cigarette initially having a hollow space at the lighting end of said cigarette, and permitting said discharged tobacco to creep into and fill said hollow space.

14. A method of assembly of a cigarette, which comprises:

providing a preformed cigarette paper tube having a tobacco smoke filter at one end thereof and open at another end thereof to a hollow interior;

providing a preformed cartridge comprising a charge of cut tobacco within a sheath having an outside diameter such as to enable such sheath to be received in telescoping relationship with the interior of said preformed cigarette paper tube and a hollow tubular extension from one end of said sheath, wherein said charge of cut tobacco is of a length corresponding to a portion only of the length of the hollow interior of said preformed cigarette paper tube when discharged from said preformed cartridge, inserting said preformed cartridge into the hollow interior of said preformed cigarette paper tube such that the sheath is located inside said preformed paper tube and said hollow tubular extension extends from said open end of said preformed paper tube, immobilizing said preformed paper tube and said charge of tobacco relative to one another, holding said hollow tubular extension and pulling on said hollow tubular extension to withdraw said sheath from the interior of said preformed cigarette paper tube, whereby said charge of cut tobacco is ejected from said sheath and into the interior of said preformed cigarette paper tube, and effecting said steps of insertion, immobilizing, holding and withdrawing for a plurality of such cartridges to provide a finished cigarette.

15. The method of claim 14 wherein a plurality of said cartridges is provided, each containing a different blend of tobacco and each of a length such that a combination thereof corresponds in length to the length of the interior of said preformed cigarette paper tube, and said sequence of steps are effected to the required number of charges of cut tobacco to fill the hollow interior and provide a cigarette ready for smoking containing segments of different blends of tobacco.

16. A method of assembly of a cigarette, which comprises:

providing a preformed cigarette paper tube having a tobacco smoke filter at one end thereof and open at another end thereof to a hollow interior;

providing a preformed cartridge comprising a charge of cut tobacco within a sheath having an outside diameter such as to enable such sheath to be received in telescoping relationship with the interior of said preformed cigarette paper tube and a hollow tubular extension from one end of said sheath, wherein said charge of cut tobacco is of a length such as to fill at least a portion of said hollow interior f said preformed cigarette paper tube when discharged from said preformed cartridge, inserting said preformed cartridge into the hollow interior of said preformed cigarette paper tube such that the sheath is located inside said preformed paper tube and said hollow tubular extension extends from said open end of said preformed paper tube, positioning the resulting combination on an elongate movable carrier mounted to an elongate stationary frame and located adjacent one extremity of movement thereof;

moving said elongate movable carrier towards another extremity of movement thereof, towards an axially extending stationary rod mounted to said frame and in axial alignment with said combination and extending for a distance such that as said carrier approaches said another extremity of movement thereof until an end of said rod enters said hollow tubular extension and abuts against said charge of cut tobacco;

moving a movable sleeve having an outside diameter corresponding to the inside diameter of said hollow tubular extension and mounted in sliding relation with respect to said stationary rod into the interior of said hollow tubular extension in sliding fit relationship therewith;

gripping the hollow interior extension against said sleeve while said carrier and combination are held against longitudinal movement to effect said holding step;

drawing said hollow tubular extension and sleeve axially away from said carrier to effect withdrawal of said sheath and cause said abutment of said end of said rod on said charge of tobacco during such axial drawing step to discharge said charge of cut tobacco from said sheath to the hollow interior of said preformed cigarette paper tube.

17. The method of claim 16 wherein the end of said stationary rod which abuts said charge of tobacco is of enlarged diameter corresponding to the inside diameter of said preformed paper tube.

18. The method of claim 17 wherein said combination is positioned on such carrier in such a way that, when said carrier reaches its another extremity of movement thereof, said enlarged end of said rod just comes into contact with said charge of cut tobacco.

19. Apparatus for assembly of a cigarette, comprising:

elongate frame means, elongate carrier means mounted to said frame means and movable axially with respect to said frame means between first and second extremities of movements for transportation of a cigarette rod thereon, elongate rod means mounted to said frame means and extending axially towards to said carrier means in axial alignment with the intended position of a cigarette rod on said carrier means, and sleeve means mounted in slidable relationship on said elongate rod means.

20. The apparatus of claim 19 wherein said elongate rod means has an enlarged diameter head.

21. Apparatus for assembly of a cigarette, comprising:

elongate frame means, elongate carrier means mounted to said frame means and movable axially with respect to said frame means between first and second extremities of movements for transportation of a cigarette rod thereon, elongate rod means mounted to said frame means and extending axially towards to said carrier means in axial alignment with the intended position of a cigarette rod on said carrier means, and sleeve means mounted in slidable relationship on said elongate rod means, said enlarged diameter head being of a size to permit the same to enter into a hollow tubular extension of a cylindrical sheath and abut against a charge of tobacco contained in the sheath, while the sheath is located in sliding fit relationship with a preformed cigarette paper tube having a cigarette smoke filter and mounted on said elongate carrier means.

22. The apparatus of claim 21 wherein said sleeve has an outside diameter corresponding to the internal diameter of said paper tube.

23. The apparatus of claim 22 wherein said extremities of movement of said carrier means are defined by abutments on said frame means.

24. The apparatus of claim 23 wherein said carrier means has an axially-extending groove therein for receiving said cigarette rod thereon.

25. The apparatus of claim 24 wherein said carrier means has adjustable stop means adjacent one end to abut the cigarette smoke filter of a cigarette rod received on said carrier means to enable adjustment of the position of the cigarette rod relative to said elongate rod when said carrier means is at its forward extremity.

* * * * *